US011490746B2

(12) United States Patent
Veraza Osorio

(10) Patent No.: US 11,490,746 B2
(45) Date of Patent: Nov. 8, 2022

(54) TUBULAR STRUCTURAL PROFILE AND CONSTRUCTION SYSTEM

(71) Applicant: CARLOS TOMAS VERAZA OSORIO PUBLICIDAD SpA, Santiago de Chile (CL)

(72) Inventor: Carlos Tomas Veraza Osorio, Santiago de Chile (CL)

(73) Assignee: CARLOS TOMAS VERAZA OSORIO PUBLICIDAD SpA, Santiago de Chile (CL)

( * ) Notice: Subject to any disclaimer, the term of this patent is extended or adjusted under 35 U.S.C. 154(b) by 0 days.

(21) Appl. No.: 17/296,315

(22) PCT Filed: Nov. 29, 2018

(86) PCT No.: PCT/CL2018/050118
§ 371 (c)(1),
(2) Date: May 24, 2021

(87) PCT Pub. No.: WO2020/107132
PCT Pub. Date: Jun. 4, 2020

(65) Prior Publication Data

US 2021/0393053 A1 Dec. 23, 2021

(51) Int. Cl.
*A47F 5/13* (2006.01)
*A47F 5/11* (2006.01)
(Continued)

(52) U.S. Cl.
CPC ..... *A47F 5/13* (2013.01); *A47B 55/06* (2013.01); *A47B 96/1433* (2013.01); *A47F 5/11* (2013.01);
(Continued)

(58) Field of Classification Search
CPC ..... A47B 55/06; A47B 96/1433; A47B 2220/0083; A47B 96/14; A47B 43/02;
(Continued)

(56) References Cited

U.S. PATENT DOCUMENTS 2,444,183 A * 6/1948 Cahners ..... B65D 19/0016 108/51.3
2,609,136 A * 9/1952 Sider ..... B65D 5/505 206/521

(Continued)

FOREIGN PATENT DOCUMENTS

| | | |
|---|---|---|
| FR | 2769812 | 4/1999 |
| FR | 2951705 | 4/2011 |
| GB | 928141 | 6/1963 |

*Primary Examiner* — Jennifer E. Novosad
(74) *Attorney, Agent, or Firm* — Defillo & Associates, Inc; Evelyn A. Defillo

(57) ABSTRACT

A tubular structural profile and construction system, produced by cutting and folding a semi-rigid and foldable sheet, having four orthogonal layers joined at fold lines and two internal diagonal layers joining two opposing fold lines. The sheet has six rectangular sections. The cutting lines are positioned for at least one tongue, which coincides with at least one slot located on an opposing fold lines, such that, during the folding, the profile is closed of the coming together of fold lines and both internal diagonal layers, and by means of the insertion of at least one tongue on its corresponding slot, and wherein, in addition, the profile of the formed system can have at least one break in the second external layers and in the two internal diagonal layers, which permit the creation of an engaging area for transverse structural profiles.

7 Claims, 7 Drawing Sheets

(51) Int. Cl.
*A47B 55/06* (2006.01)
*A47B 96/14* (2006.01)
*B65D 19/20* (2006.01)

(52) U.S. Cl.
CPC ..... *A47F 5/112* (2013.01); *B65D 19/20* (2013.01); *A47B 2220/0083* (2013.01)

(58) Field of Classification Search
CPC . A47B 47/06; A47F 5/112; A47F 5/13; A47F 5/11; A47F 5/116; B65D 19/20; B65D 5/006; B65D 5/445
USPC ..... 211/73, 72, 135, 183; 229/191, 918
See application file for complete search history.

(56) References Cited

U.S. PATENT DOCUMENTS 3,115,105 A * 12/1963 Allen ..... B65D 19/0012 108/51.3
3,292,796 A * 12/1966 Paige ..... A47F 5/114 211/132.1
3,606,230 A * 9/1971 Hargreaves ..... B60R 9/052 248/346.01
3,698,564 A * 10/1972 Muller ..... E04C 3/32 211/119.003
3,877,396 A * 4/1975 Patterson ..... A47B 47/06 108/183
4,102,276 A * 7/1978 Roveroni ..... A47F 5/116 108/156
4,102,525 A * 7/1978 Albano ..... A47B 47/06 108/51.3
4,231,299 A * 11/1980 Gebhardt ..... A47F 5/116 108/190
4,248,350 A * 2/1981 Gilbert ..... B65D 5/5033 206/320
4,333,622 A 6/1982 Albano
4,563,377 A * 1/1986 Meili ..... B65D 19/0095 108/51.3
4,595,137 A * 6/1986 Kupersmit ..... B65D 5/445 229/117.01
4,864,940 A * 9/1989 Dunn ..... B65D 19/0012 108/51.3
5,339,746 A * 8/1994 Vannatta ..... B65D 19/0012 108/51.3
5,394,810 A * 3/1995 Howard ..... A47B 3/00 100/157
5,423,270 A * 6/1995 Kilpatrick ..... B65D 19/0095 108/51.3
RE35,131 E * 12/1995 Youell, Jr. ..... B65D 19/0012 108/51.3
5,660,119 A * 8/1997 Perkins ..... B65D 19/0012 108/51.3
6,378,764 B1 * 4/2002 Teixidor Casanovas ..... B65D 5/0065 206/509
7,111,735 B2 * 9/2006 Lowry ..... B65D 5/52 206/586
7,281,648 B2 * 10/2007 Lowry ..... B65D 5/321 206/511
7,546,927 B2 * 6/2009 Lowry ..... A47F 3/142 206/557
7,905,183 B2 * 3/2011 Gibson ..... B65D 19/0022 108/51.3
8,459,190 B2 * 6/2013 Erdie ..... B65D 5/04 108/51.3
8,783,547 B2 * 7/2014 Tabor ..... B65D 81/022 229/100
8,833,573 B2 * 9/2014 Tomaszewski ..... B65D 19/385 211/126.12
9,185,984 B2 * 11/2015 Henke ..... B32B 3/04
9,428,298 B2 * 8/2016 Bersamin ..... B65D 5/445
9,655,446 B2 * 5/2017 Brady ..... A47F 5/114
9,783,333 B1 * 10/2017 De Los Santos ..... B65D 5/006
9,826,843 B1 * 11/2017 Tomaszewski ..... B65D 5/002
9,844,281 B2 * 12/2017 Fernandez ..... A47B 45/00
10,301,066 B2 * 5/2019 Van Riper ..... B65D 19/0018
10,687,636 B2 * 6/2020 Frost ..... A47F 5/0068
10,745,171 B2 * 8/2020 Pfeifer ..... B65D 19/0012
2002/0088378 A1 * 7/2002 Simms ..... B65D 19/0012 108/51.3
2008/0236002 A1 10/2008 Virvo
2009/0032432 A1 * 2/2009 Kostos ..... B65D 71/0096 206/600
2009/0223421 A1 * 9/2009 Ferguson ..... B65D 19/0026 108/51.3
2011/0168766 A1 * 7/2011 Erdie ..... B65D 59/08 229/103.2
2011/0271623 A1 11/2011 Kurath-Grollmann
2017/0295927 A1 10/2017 Gibbons, Jr. et al.
2021/0393053 A1 * 12/2021 Veraza Osorio ..... A47F 5/13

* cited by examiner

TUBULAR STRUCTURAL PROFILE AND CONSTRUCTION SYSTEM

CROSS REFERENCE TO RELATED APPLICATION

This application is a national stage entry of PCT/CL2018/050118 filed Nov. 29, 2018, under the International Convention.

FIELD OF THE INVENTION

The present invention has various fields of application, especially in the manufacture of composite structures for the packaging industry, furniture, the display of consumer products for sale, as for example.

Problem to be Solved

The technical problem to be solved refers to achieving a structural profile and a composite structure or construction system using this profile, made of semi-rigid and foldable material, such as cardboard, to create a rigid and lightweight structure through folds of a sheet, applicable in various fields, especially in the manufacture of composite structures for the packaging industry, furniture, the display of products for sale, as for example.

The specific case of short time structures, which are preferably composed of recyclable materials such as cardboard and some kinds of plastics, is becoming increasingly relevant, both due to environmental regulations and to the cost efficiency of the recycling process, which makes it necessary to innovate in structural elements, and composite structures with a technical advantage in their conception, and to avoid the incorporation of other materials, different from the main material.

In the case of cardboard, a material especially suitable for recycling after use, for displaying furniture, it is usually necessary to incorporate fastening and reinforcing elements made of other materials, such as metal bolting, and plastic or metal clips, and for packaging, reinforcing elements, such as polystyrene and polyethylene foams or rigid profiles containing resins binders are difficult and expensive to recycle.

Another facet of the technical problem addressed by this innovation is the growing need, in the retail market, to find an optimization of operating costs and minimization of environmental impacts, from the transport of products from factories to the retail sale point, through the use of product container furniture, which has the structural strength to contain the products for transport, in addition to having design characteristics that allow buyers to easily view the products and remove them from the cabinet for purchase. In this particular application, due to existing technologies, several operational and environmental problems currently arise both at the place where the structure is loaded and at the point where the furniture is emptied and must be arranged as residue. These problems arise firstly because the frames of the furniture currently used do not allow the strengths and structural stiffnesses necessary to fulfill the multiplicity of functions without the use of other elements and especially additional fixing elements for assembly, and in most cases also specialized tools to insert these elements. Another problem is related to the logistical difficulties within the factories, as it is necessary to transport furniture from an assembly area to a product loading area. Additionally, in the selling place, it is necessary to apply specialized techniques and tools for the dismantling of the furniture already used, prior to its disposal.

In front of the needs related to the different facets of this technical problem, it is necessary to achieve a new structural profile and a composite structure or construction system based on this profile.

STATE OF THE ART

Document US2011271623 (A1) discloses a construction element for buildings that has a hollow body, which extends along a longitudinal axis and has a substantially rectangular cross section, in which the corners can be rounded, and at least one first and a second strut extending between diagonally opposite edges on the hollow body. The braces can absorb compressive loads, but not tensile. Different prefabricated elements can be positioned in the place of the braces. Although the innovation contains elements in common with the present invention, it does not contemplate the elements necessary for an assembly of the structural element from a sheet of material, but rather requires a closed tube as base material, plus the braces.

Document FR2951705 (A1) discloses a pallet beam that is made from the fold of a rectangular cardboard sheet that comprises parallel folding lines that divide the sheet into 8 rectangular sectors, to obtain a solid piece. The innovation comprises elements in common with the present invention, such as a diagonal portion and faces and 4 substantially orthogonal sheets, but its folding shape is different and does not contemplate other necessary elements for closing the profile, such as the tabs and grooves where these are inserted.

Document U.S. Pat. No. 4,563,377 (A) discloses a high-strength tubular beam of corrugated cardboard, for example, for the construction of disposable pallets, comprising a single cardboard sheet that is folded several times on itself to form a rectangular or rectangular or isosceles trapezoid outer section, divided into two adjacent rectangular or trapezoidal sections, each comprising two mutually inverted triangular sections that have a diagonal in common. The innovation has elements in common with the present invention, however, it differs in its way of folding and tracing the sheet, in addition to contemplating simple diagonal sections not formed by two sheets as in the present invention, and further more, it does not contemplate closing means for the profile, which can only achieve closure and structural resistance when adhered to an external element by its open face.

Document U.S. Pat. No. 4,333,622 (A) discloses a knock-down spacer for bookshelves and the like which is made from a single elongated rectangular blank of sheet material, creased at spaced intervals to fold into an open-ended box-like block with internal diagonal bracing walls. The outer walls of the box structure wrap around the diagonal braces and one end of the blank has a retaining flap which overlaps one of the walls and is secured by releasable fasteners. The has presents elements in common with the present invention, however, it differs in its way of folding and tracing the sheet, in addition to contemplating, and additionally, it does not contemplate closing means generated in the sheet of material, but rather requires of external elements.

SUMMARY OF THE INVENTION

A tubular structural profile is disclosed, manufactured from the folding and cutting of a sheet of semi-rigid and foldable material, with high vending, compressive and torsion stiffness, whose outer contour comprises 4 substantially orthogonal sheets joined in folding lines, and an inner portion, located diagonally joining two opposite folding lines, and a constructive system or structure composed of the aforementioned profile, where the sheet of semi-rigid material has 6 rectangular, adjacent and parallel portions, separated from each other by folding lines, where the two central portions correspond to two first outer sheets (1, 2), separated by a first folding line (10), followed towards the ends of two second outer sheets (3, 4), separated from the first outer sheets by two second folding lines (11, 12), and then symmetrically two inner diagonal sheets (5, 6), separated from the second outer sheets by two third folding lines (13, 14); each fold is made in a single direction of rotation, where the fold of the sheet on the third folding lines is made at a rotation angle greater than 90° to position the two diagonal sheets, and then fold the sheet on the second fold lines at a substantially right angle, followed by the fold on the first fold line at a substantially right angle; on one of the third folding lines, cut lines of at least one tab (7) are positioned, which coincides with at least one slot (8) located on the third opposite folding line, allowing that during the fold, the tubular structural profile is closed by the coincidence of both third folding lines and both internal diagonal sheets (5, 6), and the insertion of the at least one tab (7) in its corresponding slot (8), preventing the profile from opening during its structural performance. The tubular structural profile can have at least one interruption in the second outer sheets (3, 4) and in the two inner diagonal sheets (5, 6), in a symmetrical way, which allow to create a fitting area (15) for transversal structural profiles that make up a set of elements of the construction system or composite structure.

BRIEF DESCRIPTION OF TE DRAWINGS

DETAILED DESCRIPTION OF THE INVENTION

Figure 1:
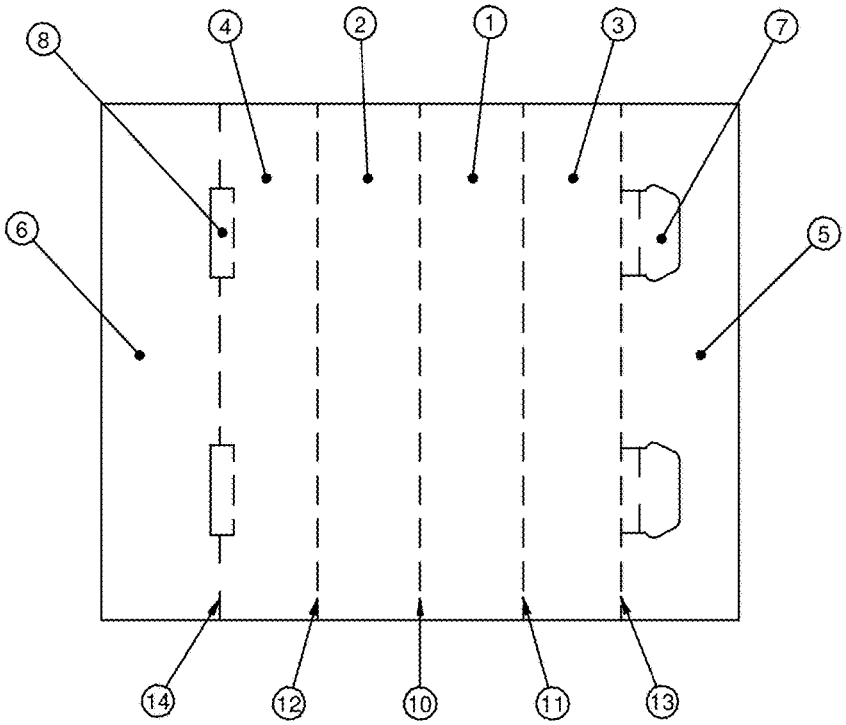
FIG. 1 shows a layout of the sheet from which the tubular structural profile is made.

The present invention has various fields of application, especially in the manufacture of composite structures for the packaging industry, furniture, the display of consumer products for sale, as for example.

A tubular structural profile is disclosed, manufactured from the folding and cutting of a sheet of semi-rigid and foldable material, with high vending, compressive and torsion stiffness, whose outer contour comprises 4 substantially orthogonal sheets joined in folding lines, and an inner portion, located diagonally joining two opposite folding lines, and a constructive system or structure composed of the aforementioned profile, where the sheet of semi-rigid material has 6 rectangular, adjacent and parallel portions, separated from each other by folding lines, where the two central portions correspond to two first outer sheets (1, 2), separated by a first folding line (10), followed towards the ends of two second outer sheets (3, 4), separated from the first outer sheets by two second folding lines (11, 12), and then symmetrically two inner diagonal sheets (5, 6), separated from the second outer sheets by two third folding lines (13, 14); each fold is made in a single direction of rotation, where the fold of the sheet on the third folding lines is made at a rotation angle greater than 90° to position the two diagonal sheets, and then fold the sheet on the second fold lines at a substantially right angle, followed by the fold on the first fold line at a substantially right angle; on one of the third folding lines, cut lines of at least one tab (7) are positioned, which coincides with at least one slot (8) located on the third opposite folding line, allowing that during the fold, the tubular structural profile is closed by the coincidence of both third folding lines and both internal diagonal sheets (5, 6), and the insertion of the at least one tab (7) in its corresponding slot (8), preventing the profile from opening during its structural performance. The tubular structural profile can have at least one interruption in the second outer sheets (3, 4) and in the two inner diagonal sheets (5, 6), in a symmetrical way, which allow to create a fitting area (15) for transversal structural profiles that make up a set of elements of the construction system or composite structure.

The first folding line (10) of the tubular profile can be divided into two parallel rectilinear paths, separated from each other by a distance similar to twice the thickness of the material sheet, so that during the vending, a surface between both paths contacts in an integral manner the outer edges of the two inner diagonal sheets (5, 6), in order to produce an increase in the strength and structural stability of the profile.

The width of the two inner diagonal sheets (5, 6) of at least one of the tubular structural profiles that make up the composite structure can be less than the inner diagonal distance between two opposite fold lines, to generate a tight space for folding the profile around an angle profile, preferably coming from the folding of another sheet of semi-rigid material, thus allowing the structural solidarity of the collinear structural profiles with each other.

The tubular structural profile of the construction system has at least one interruption (15) in the second outer sheets (3, 4) and in the two inner diagonal sheets (5, 6), in a symmetrical way, which create an insertion zone for cross-sectional structural profiles that make up a set of elements of a composite structure.

The angle profile (9) may contain transverse extensions to its longitudinal axis, which can join it with at least one other angle profile substantially parallel to the first, preferably included in the fold of the same sheet of material, and also the interruptions in the second outer sheets (3, 4) and on the two inner diagonal sheets (5, 6), preferably coincide with these extensions.

DESCRIPTION OF THE PREFERRED EMBODIMENTS

A first preferred application of the tubular structural profile of the present invention corresponds to the generation of linear reinforcements, resistant to external bending and compression forces, for the reinforcement of packaging, preferably for closed or semi-closed cardboard boxes, to be installed internally to them and preferably along their edges, thus avoiding their collapse due to stacking loads and impacts. Additionally, the profile can be installed in the form of a parallel, for the reinforcement of container bases, to increase their weight-bearing capacity, generating a high-resistance base against compressive and bending loads without the need to incorporate other materials.

A second preferred application of the tubular structural profile and of the composite structure of the profile, corresponds to the manufacture of pallets for the stacking, transport and storage of products, where a resistant frame, generated from a contour of profiles in horizontal parallelepiped arrangement is reinforced by inserting horizontal tubular profiles, with the application of at least 4 short sections of tubular profiles under the resistant frame to generate supports towards the floor. A third preferred application consists in the manufacture of furniture for display and sale of products in the retail trade, which have structural strength and external dimensions suitable for transport and storage on pallets, and assembly and disassembly on site, without the need for specialized tools or additional materials, which includes the generation of composite structures, from plastic or cardboard sheets, of at least 3 pillars formed with the tubular structural profile, assembled together by folding a sheet around another, where the internal diagonal sheets (5, 6) of the profiles present interruptions, coincident in height between the pillars, for the insertion of transverse profiles that are conveniently joined to contained horizontal surfaces between the pillars, those that allow the maintenance of the products in storage, transport, exhibition and sale.

The symbols used are as follows:

(1, 2) First outer sheets
(3, 4) Second outer sheets
(5, 6) Diagonal inner sheets
(7) Tab
(8) Slot
(9) Angle profile
(10) First folding line
(11, 12) Second folding lines
(13, 14) Third folding lines
(15) Fitting area FIG. 1 shows a layout of the sheet from which the tubular structural profile is made, indicating its folding lines (10, 11, 12, 13, 14) and also its first outer sheets (1, 2), second outer sheets (3, 4), inner diagonal sheets (5, 6), at least one tab (7) and correspondingly at least one slot (8).

Figure 2:
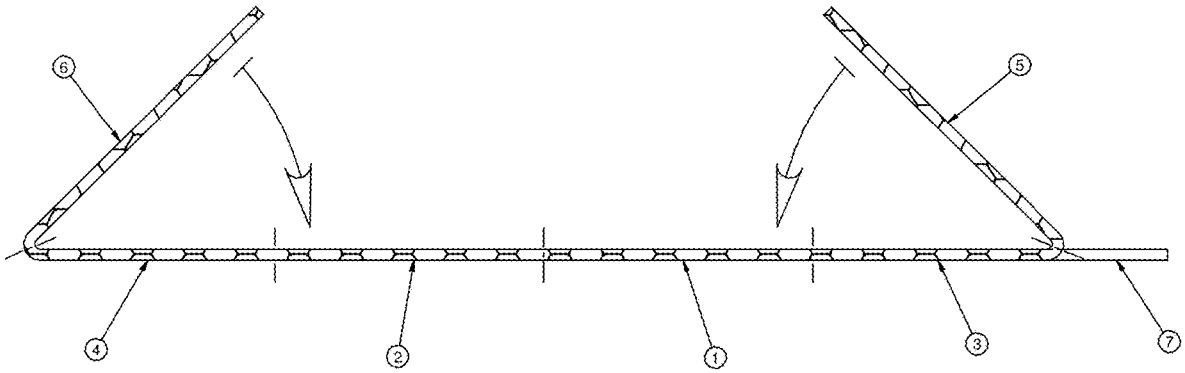
FIG. 2 shows a first folding stage of the tubular structural profile.

FIG. 2 shows a first folding stage of the tubular structural profile, in which the inner diagonal sheets (5, 6) are bent at an angle greater than 90° in a symmetrical manner.

Figure 3:
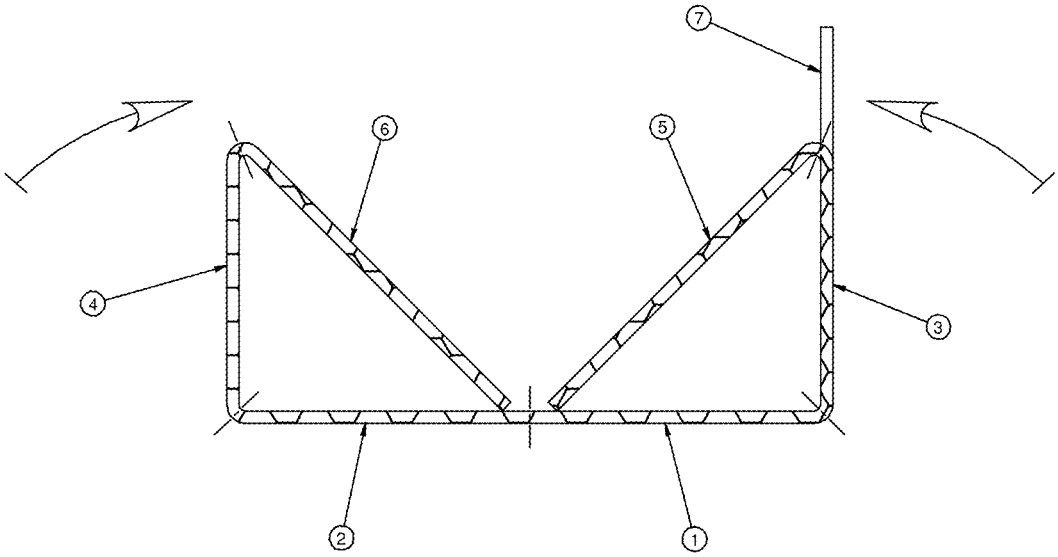
FIG. 3 shows a second folding stage of the tubular structural profile.

FIG. 3 shows a second folding stage of the tubular structural profile, in which the second outer sheets (3, 4) are folded at right angles in a symmetrical way.

Figure 4:
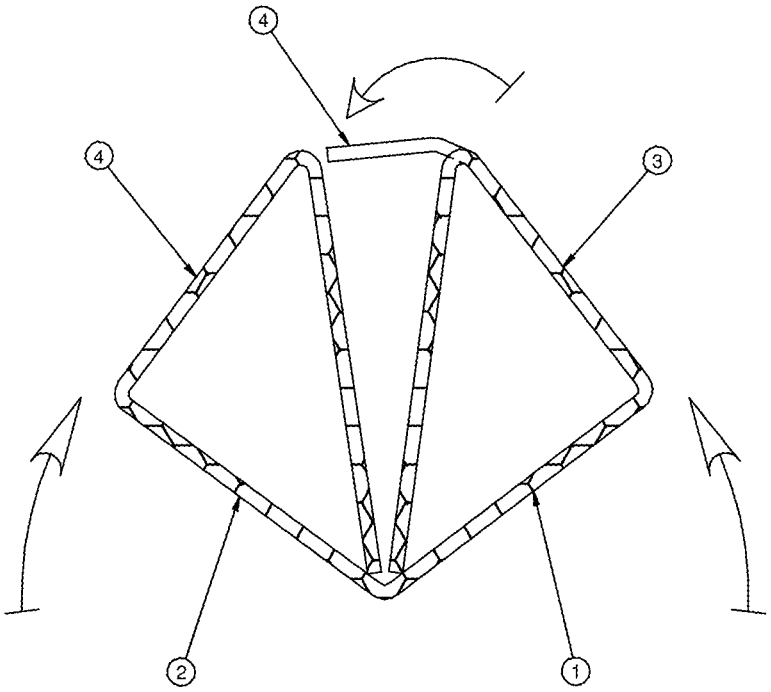
FIG. 4 shows a third folding stage of the tubular structural profile.

FIG. 4 shows a third folding stage of the tubular structural profile, in which the first outer sheets (1, 2) are folded on the first folding line and in which at least one tab (7) is folded and inserted inside of at least one slot (8), allowing the final closure of the profile.

Figure 5:
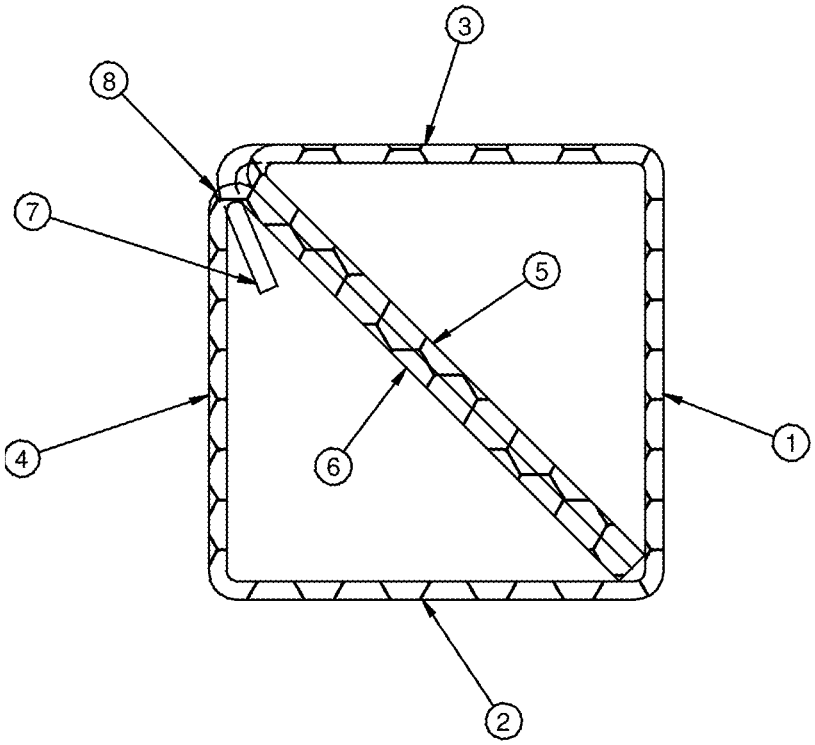
FIG. 5 shows the tubular structural profile in a folded and closed state.

FIG. 5 shows the tubular structural profile in a folded and closed state, indicating the corresponding position to its different elements, such as the first outer sheets (1, 2), the second outer sheets (3 and 4), the inner diagonal sheets (5, 6) located joining diagonally opposite folding lines in the profile, and the tab (7) inserted into the slot (8).

Figure 6:
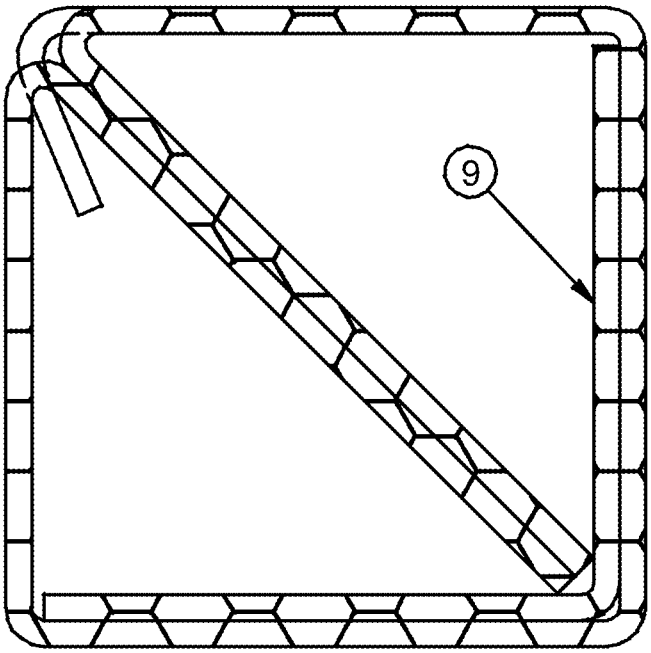
FIG. 6 shows a detail of the assembly of the tubular structural profile around an angle profile (9)

FIG. 6 shows a detail of the assembly of the tubular structural profile around an angle profile (9), for the solidarity of the structure formed from the profile, allowing a firm union of collinear profiles with each other, in which the inner diagonal sheets (7, 8) are shorter, in order to create the space required for the angle profile (9).

Figure 7:
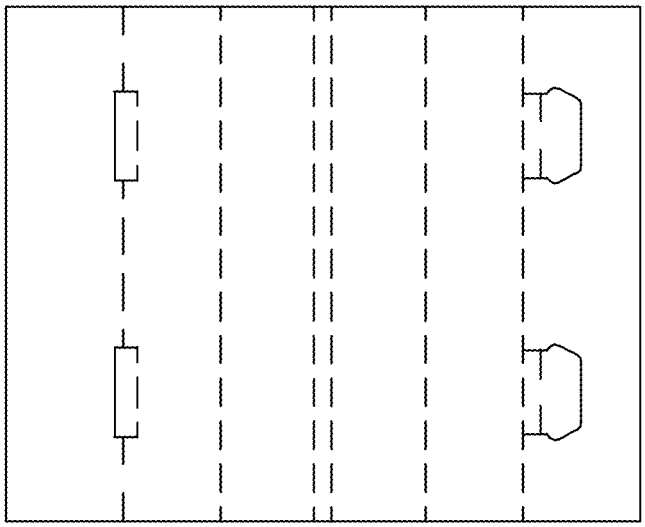
FIG. 7 shows a layout of the sheet from which the tubular structural profile is made.

FIG. 7 shows a layout of the sheet from which the tubular structural profile is made, in which its first folding line (10) is made up of two parallel paths, separated from each other by a distance similar to twice the thickness of the sheet material.

Figure 8:
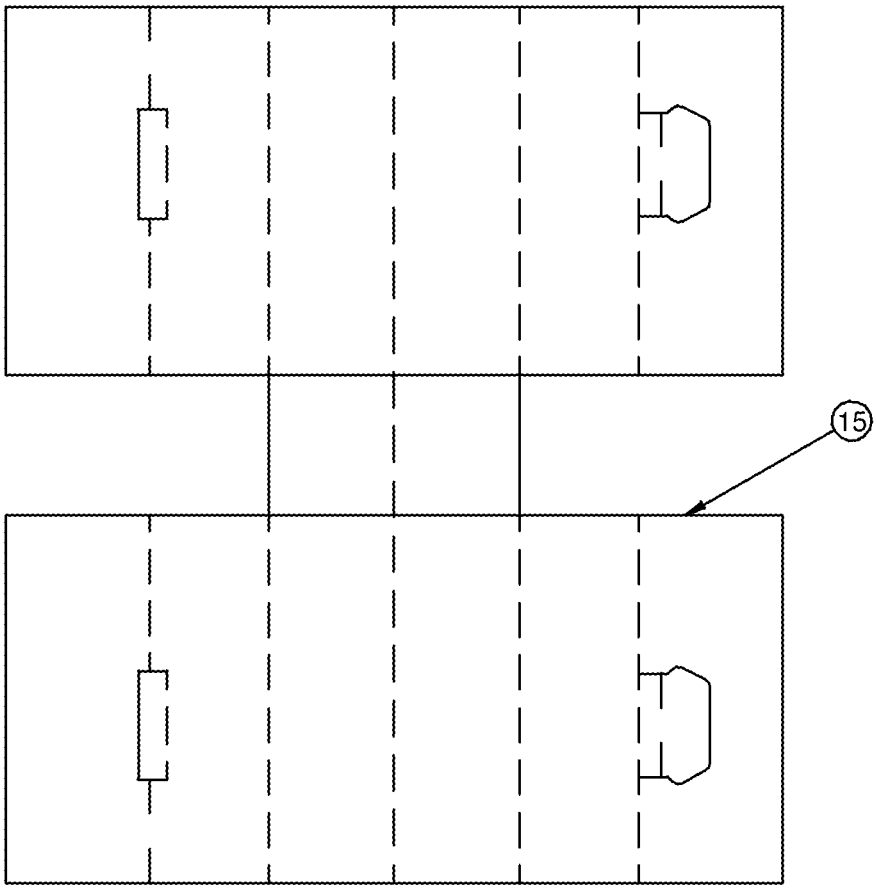
FIG. 8 shows an example of symmetrical interruption (15) in the second outer sheets (3, 4) and in the two inner diagonal sheets (5, 6), to create an insert zone (15)

FIG. 8 shows an example of symmetrical interruption (15) in the second outer sheets (3, 4) and in the two inner diagonal sheets (5, 6), to create an insert zone (15) for transverse structural profile elements that compose a set of elements of a composite structure and/or to allow a collinear assembly of the tubular structural profile with an angle profile (9) that presents transversal extensions.

Figure 9:
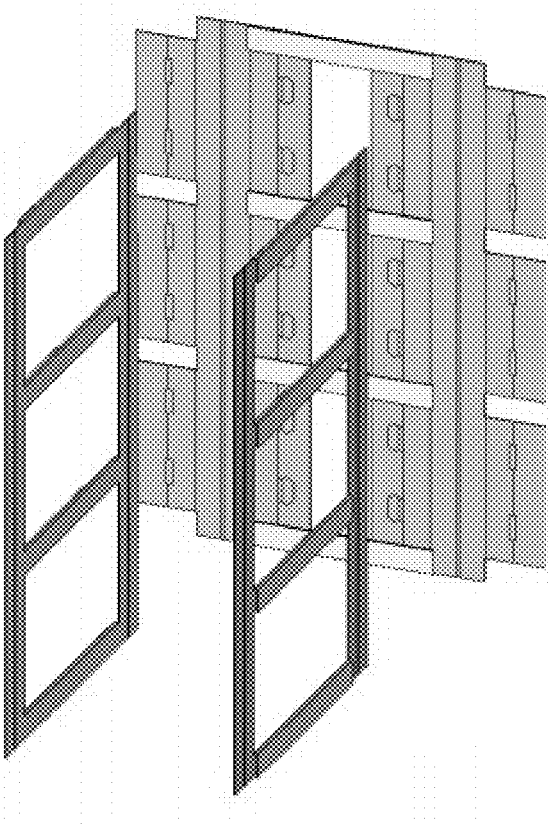
FIG. 9 shows a sequence of execution of one of the ways of application of the composite structure using the tubular structural profile and its inserts.
Figure 10:
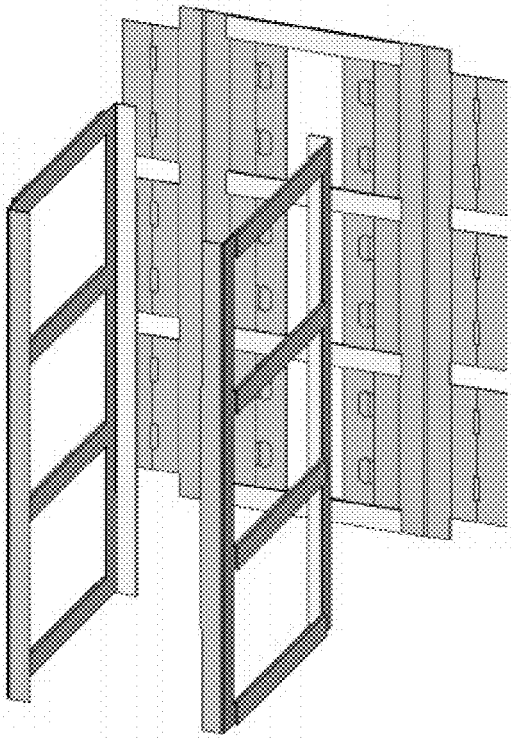
FIG. 10 shows another sequence of execution of one of the ways of application of the composite structure using the tubular structural profile and its inserts.
Figure 11:
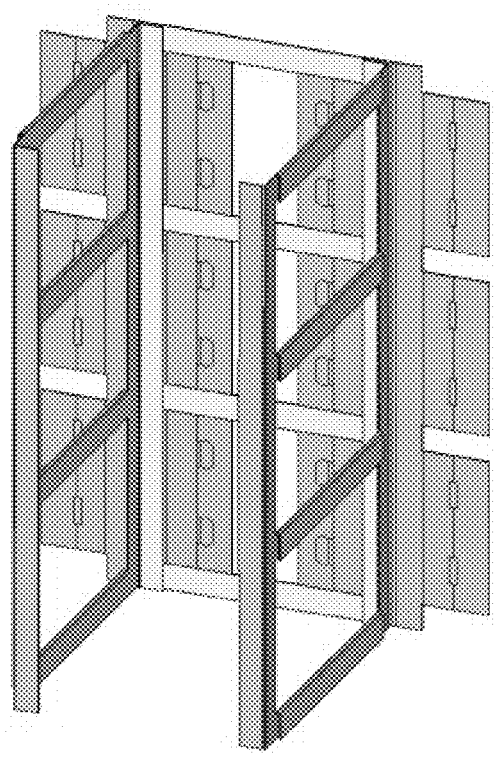
FIG. 11 shows another sequence of execution of one of the ways of application of the composite structure using the tubular structural profile and its inserts.
Figure 12:
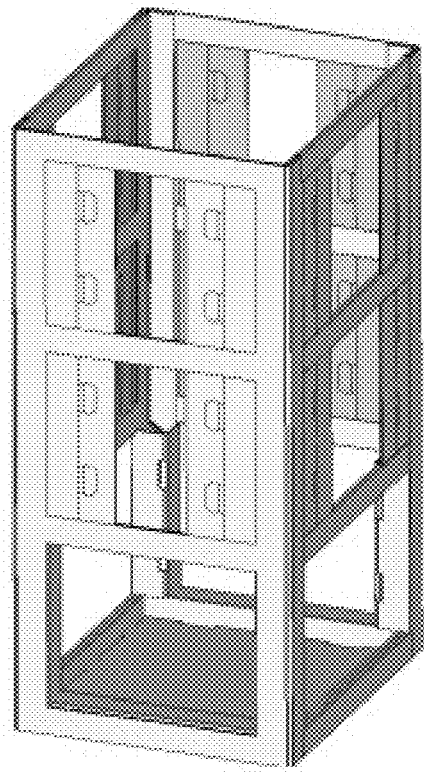
FIG. 12 shows another sequence of execution of one of the ways of application of the composite structure using the tubular structural profile and its inserts.
Figure 13:
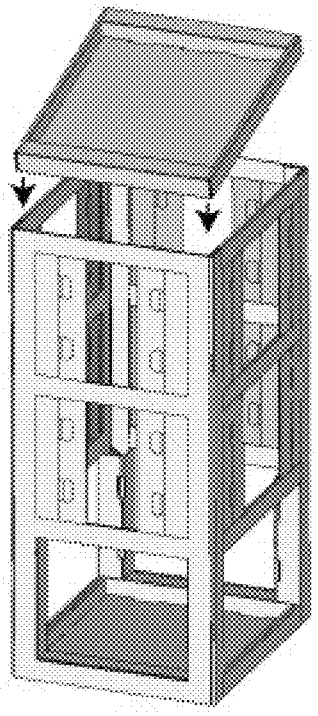
FIG. 13 shows another sequence of execution of one of the ways of application of the composite structure using the tubular structural profile and its inserts.
Figure 14:
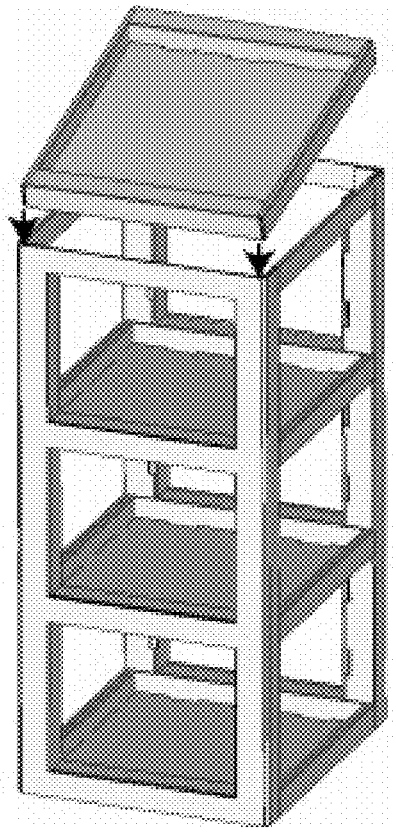
FIG. 14 shows another sequence of execution of one of the ways of application of the composite structure using the tubular structural profile and its inserts.

FIGS. 9, 10, 11, 12 and 13 show a sequence of execution of one of the ways of application of the composite structure using the tubular structural profile and its inserts, corresponding to a piece of furniture, where FIG. 9 shows two structural frames formed from folded sheets, which end on their sides in angle profiles (9), both frames being parallel to each other, and where there is also a first sheet with cuts and traces of folds of the structural profile, with reliefs for inserts of transverse profiles, which is located behind the two frames. FIG. 10 shows a first fit between both frames, in which one of the first outer sheets (1,2) of each tubular structural profile is positioned wedging against one of the wings of the angle profile (9) of one of the sides of each frame. FIG. 11 shows a next stage of execution, in which a second sheet has been added with cuts and folding lines of the structural profile, with reliefs for inserts of transverse profiles, similar to the first, both paved with the two frames, where a first structural tray has also been installed in the area of the base of the composite structure, which in at least two of its opposite edges contains folds that make up tubular profiles, after which the lower parts of the sheets with cuts and pleat traces of the structural profile have been folded and closed around the angle profile wings of the frames, generating a blockage of the first tray and generating a 4-corner fitting area for a second tray. FIG. 12 shows the entry of the second structural tray to rest on the 4-corner fitting, after which tubular structural profiles will be folded and closed around the angle profile wings of the frames on a second level. FIG. 13 shows the final stage of the execution, in which the different levels of structural profiles have been folded and closed around the frames and the trays have been installed, remaining blocked, culminating in the installation of a last tray on top.

The invention claimed is:

1. A tubular structural profile manufactured from folding and cutting a sheet of a semi-rigid material comprising:

an outer contour having 4 orthogonal sheets joined together by folding lines and an inner portion located diagonally joining two opposite fold lines comprising:

a first central portion (1) and a second central portion (2) separated by a first folding line (10), a first outer sheet (3) and a second outer sheet (4), the first outer sheet (3) is separated from the first central portion (1) by a second folding line (11), the second outer sheet (4) is separated from the second central portion (2) a third folding line (12), and a first inner sheet (5) and a second inner sheet (6), the first inner sheet (5) is separated from the first outer sheet (3) by a fourth folding line (13), the second inner sheet is separated from the second outer sheet (4) by a fifth folding line (14);

at least one tab (7) is located on the fourth folding line (13);

at least one slot (8) located on the fifth folding line (14), each slot coincides with the tab (7);

wherein the tubular structural profile is assembled by rotating the first and the second inner sheets about the fourth and the fifth folding line (13, 14) at an angle greater than 90° to position the first and the second inner sheets (5, 6), then folding the second and third folding lines (11, 12) at a right angle, and then folding the first folding line (10) at a right angle; and inserting each tab (7) into the corresponding slot;

wherein the structural profile is closed by the coincidence of the fourth and fifth folding lines (13 and 14) and the first and the second inner sheets (5, 6), and the insertion of the at least one tab (7) in the corresponding slot (8).

2. The tubular structural profile of claim 1, wherein the first folding line (10) is divided into two parallel lines separated from each other, a distance similar to twice a thickness of the semi-rigid material.

3. A construction system based on a tubular structural profile that is manufactured from folding and cutting of a sheet made of a semi-rigid material comprising:

an outer contour having 4 orthogonal sheets joined in fold lines and an inner portion, the orthogonal sheets are located diagonally joining two opposite fold lines, a first central portion (1) and a second central portion (2) separated by a first folding line (10), a first outer sheet (3) and a second outer sheet (4), the first outer sheet (3) is separated from the first central portion (1) by a second folding line (11), the second outer sheet (4) is separated from the second central portion (2) by a third folding line (12), and a first inner sheet (5) and a second inner sheet (6), the first inner sheet (5) is separated from the first outer sheet (3) by a fourth folding line (13), the second inner sheet is separated from the second outer sheet (4) by a fifth folding line (14);

wherein the sheet on the third folding line (12) is rotated an angle greater than 90° to position the first and the second inner sheets (5, 6), then folding the sheet on the second and the third folding lines (11, 12), at a right angle, and then folding the first folding line (10) at a right angle;

wherein the first and the second outer sheets (3, 4) and the first and the second inner sheets (5, 6) include a cutoff section, wherein the cutoff sections are located on the same plane;

wherein the tubular structural profile is assembled by rotating the first and the second inner sheets about the fourth and the fifth folding lines (13, 14) at an angle greater than 90° to position the first and the second inner sheets (5, 6), then folding the second and third folding lines (11, 12) at a right angle, and then folding the first folding line (10) at a right angle; and inserting each tab (7) into the corresponding slot.

4. The construction system of claim 3, wherein the first folding line (10) is divided into two parallel lines separated from each other a distance similar to twice a thickness of the semi-rigid material.

5. The construction system of claim 3, wherein a width of the first and the second inner sheets (5, 6) is less than a distance between two adjacent folding lines generating a tight space for the folding of the profile around an angle profile (9).

6. The construction system of claim 5, wherein the angle profile (9) contains a longitudinal axis having transverse extensions to connect the angle profile (9) with at least one other parallel angle profile, wherein the cutoff sections of the first and the second outer sheets (3, 4) and the first and the second inner sheets (5, 6) coincide with the extensions of the angle profile.

7. A cross section of a tubular structural profile manufactured by folding and cutting a sheet of semi-rigid and foldable material comprising:

a rectangular exterior contour including 4 outer rectilinear portions, adjacent outer rectilinear portions are joined together at straight bending angles; and an inner portion located diagonally joining opposite bends, wherein:

the cross section has a first, a second, a third, a fourth, a fifth, and a sixth rectilinear portions, wherein the fifth and the sixth rectilinear portions are located towards the ends of the 4 rectilinear outer portions;

the inner portion is formed by adjacently positioning the fifth and the sixth rectilinear portions;

wherein the bending angles have the same angle;

wherein union between the fifth and the sixth rectilinear portions have a deflection angle greater than 90° and smaller than 180°.

* * * * *